US012778270B2

(12) United States Patent
Havener et al.

(10) Patent No.: US 12,778,270 B2
(45) Date of Patent: Nov. 3, 2026

(54) METHOD AND APPARATUS FOR ADJUSTABLE BACKPACK BLOWER RACK

(71) Applicant: Havener Enterprises, Inc., Bradley, IL (US)

(72) Inventors: Christopher Havener, Bradley, IL (US); Siming Wang, Bourbonnais, IL (US)

(73) Assignee: HAVEVER ENTERPRISES INC., Bradley, IL (US)

( * ) Notice: Subject to any disclaimer, the term of this patent is extended or adjusted under 35 U.S.C. 154(b) by 93 days.

(21) Appl. No.: 19/357,304

(22) Filed: Oct. 14, 2025

(65) Prior Publication Data

US 2026/0101989 A1 Apr. 16, 2026

Related U.S. Application Data

(60) Provisional application No. 63/706,978, filed on Oct. 14, 2024.

(51) Int. Cl.
*A45F 3/10* (2006.01)
*A45F 3/00* (2006.01)

(52) U.S. Cl.
CPC ..... *A45F 3/10* (2013.01); *A45F 2003/003* (2013.01)

(58) Field of Classification Search
CPC . A01G 20/47; A62C 13/78; A45F 3/08; A45F 3/047; A45F 3/10; A45F 2003/003
See application file for complete search history.

(56) References Cited

U.S. PATENT DOCUMENTS 3,490,727 A * 1/1970 Miller ..... A62C 15/00 211/101
3,780,972 A * 12/1973 Brodersen ..... A62C 13/78 211/85.18
3,861,695 A * 1/1975 Shourek ..... B62B 1/125 211/195
D319,778 S * 9/1991 Ziaylek, Jr. ..... D8/373
5,169,114 A * 12/1992 O'Neill ..... E05B 73/0082 248/680
5,423,508 A * 6/1995 Isenga ..... B60N 3/108 224/407
6,302,280 B1 * 10/2001 Bermes ..... B60R 9/00 224/403
6,702,242 B1 * 3/2004 Ziaylek, Jr. ..... A62B 25/00 297/188.05
6,926,243 B1 * 8/2005 Ziaylek ..... A62B 25/00 248/307
7,055,213 B2 * 6/2006 Lida ..... E01H 1/0809 15/330

(Continued)

FOREIGN PATENT DOCUMENTS

EP 3281551 A1 * 2/2018 ..... A01G 20/43

*Primary Examiner* — Patrick D Hawn
(74) *Attorney, Agent, or Firm* — KNECHTEL, DEMEUR & SAMLAN

(57) ABSTRACT

A backpack blower rack that is designed to provide a unique three-way adjustment to accommodate and fit different sized blowers such that this one backpack blower rack may be used with many different blowers by an operator. The backpack blower rack provides a base, a back wall, and a top support frame along with a first means for adjusting the height of the blower rack, a second means for adjusting the length of the blower rack, and a third means for adjusting the width of the blower rack.

13 Claims, 9 Drawing Sheets

(56) References Cited

U.S. PATENT DOCUMENTS

| | | | | |
|---|---|---|---|---|
| 7,367,749 | B2 * | 5/2008 | Kim | A45F 3/047 405/186 |
| 7,437,796 | B2 * | 10/2008 | Rappin | B05B 7/2475 15/327.5 |
| 8,220,764 | B2 * | 7/2012 | Ziaylek | A62B 25/00 248/316.1 |
| 9,045,918 | B2 * | 6/2015 | Sargent | A01G 20/47 |
| 10,202,786 | B1 * | 2/2019 | Keegan | A47L 5/36 |
| 10,645,884 | B2 * | 5/2020 | Poole | A47L 5/14 |
| 10,767,395 | B2 * | 9/2020 | Keegan | A01G 18/60 |
| 10,914,100 | B2 * | 2/2021 | Keegan | E05B 73/00 |
| 12,078,288 | B2 * | 9/2024 | Zarecky | A61B 8/4433 |
| 12,280,276 | B2 * | 4/2025 | Ziaylek | A62B 25/00 |
| 2001/0005918 | A1 * | 7/2001 | Miyamoto | A47L 5/36 15/327.5 |
| 2002/0060107 | A1 * | 5/2002 | Kamoshita | F04D 29/664 181/224 |
| 2009/0321481 | A1 * | 12/2009 | Licausi | A45F 3/047 224/262 |
| 2013/0220949 | A1 * | 8/2013 | Sargent | E05B 73/00 211/13.1 |
| 2015/0282435 | A1 * | 10/2015 | Mutoh | A01G 20/47 15/405 |
| 2018/0328083 | A1 * | 11/2018 | Sargent | E05B 73/00 |
| 2020/0023510 | A1 * | 1/2020 | Sargent | A47F 5/00 |
| 2022/0144180 | A1 * | 5/2022 | Bunsey | A01G 20/47 |

* cited by examiner

METHOD AND APPARATUS FOR ADJUSTABLE BACKPACK BLOWER RACK

I. CROSS-REFERENCE TO RELATED APPLICATION

This patent application is a non-provisional application claiming priority from U.S. Provisional Patent Application Ser. No. 63/706,978, entitled "Method and Apparatus For Adjustable Backpack Blower Rack", filed on Oct. 14, 2024, and is fully incorporated herein by reference

II. FIELD OF THE INVENTION

The present invention relates to backpack blower racks and, more particularly, to a backpack blower rack that is designed to provide a unique three-way adjustment to accommodate and fit different sized blowers such that this one backpack blower rack may be used with many different blowers by an operator.

III. BACKGROUND OF THE INVENTION

Backpack blower racks have been known in the art for a very long time. In all of that time, the currently available backpack blower racks are designed to accommodate certain blowers (e.g., for example, gas or battery leaf blower) and certain sizes. In this manner, the blower is inserted into the backpack blower rack, the operator straps the backpack blower rack with this blower onto their back, and then moves about the landscaping or property to operate and use the blower, as desired or needed.

Currently, while these backpack blower racks can accommodate certain blowers, they are not designed to adjust to fit most (different sized) blowers on the market, which means, that operators may be limited to either: (i) using only certain blowers with the backpack blower rack that they own, or (ii) required to own more than one backpack blower rack for their different blowers depending upon the operator's use or need for the landscaping or property work. Either way, this presents a problem for, and unnecessary cost imposed upon, the operators or their businesses.

Thus, there is a need, therefore, and there has never been disclosed Applicant's unique adjustable backpack blower rack invention.

IV. SUMMARY OF THE INVENTION

The present invention is a backpack blower rack that is designed to provide a unique three-way adjustment to accommodate and fit different sized blowers such that this one backpack blower rack may be used with many different blowers by an operator. The backpack blower rack provides a base, a back wall, and a top support frame along with a first means for adjusting the height of the blower rack, a second means for adjusting the length of the blower rack, and a third means for adjusting the width of the blower rack.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
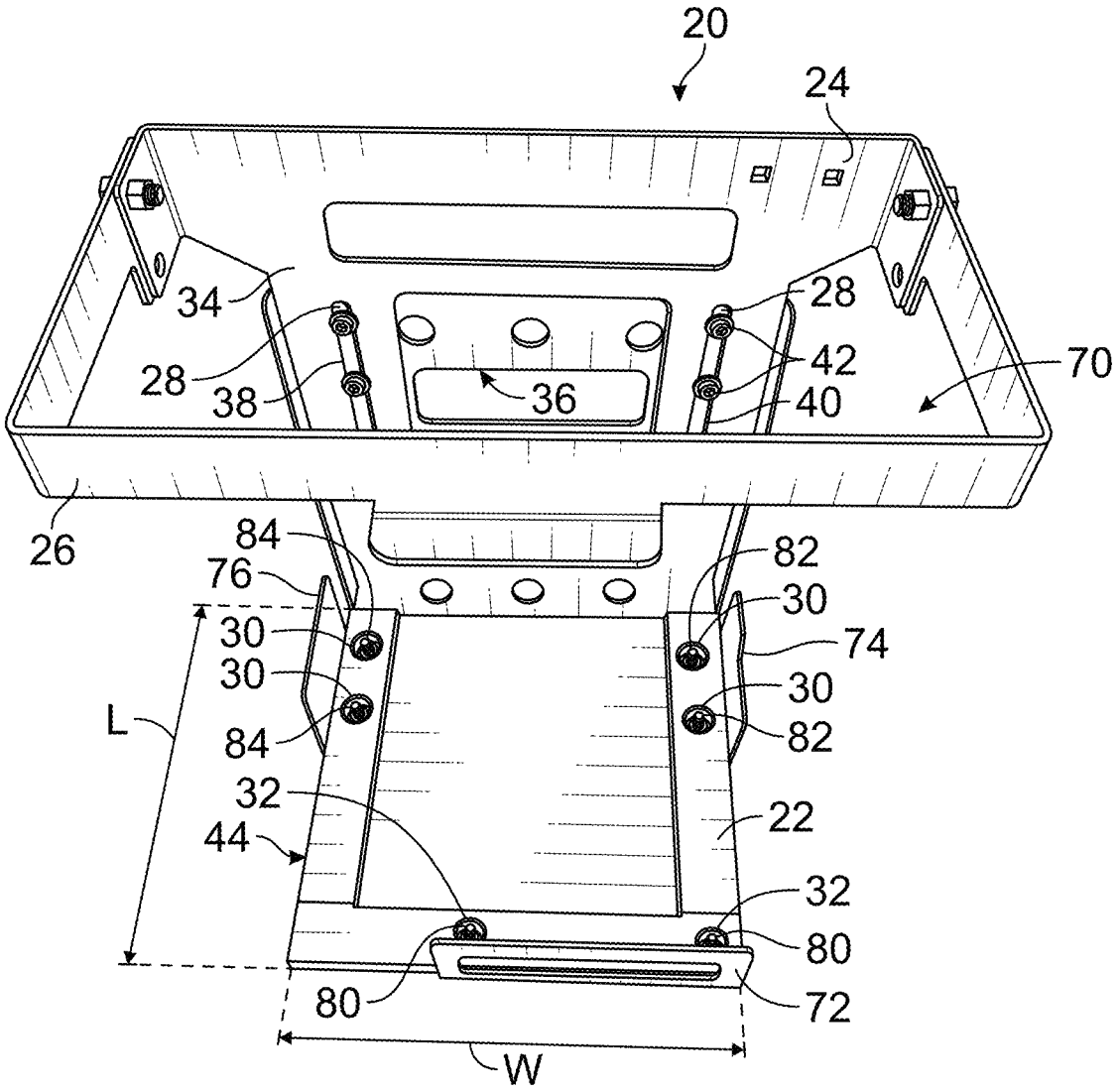
FIG. 1 is a front perspective view of the adjustable backpack blower rack and Applicant's inventive design and, in particular, illustrating a first means, second means, and third means for adjusting the backpack blower rack.
Figure 2:
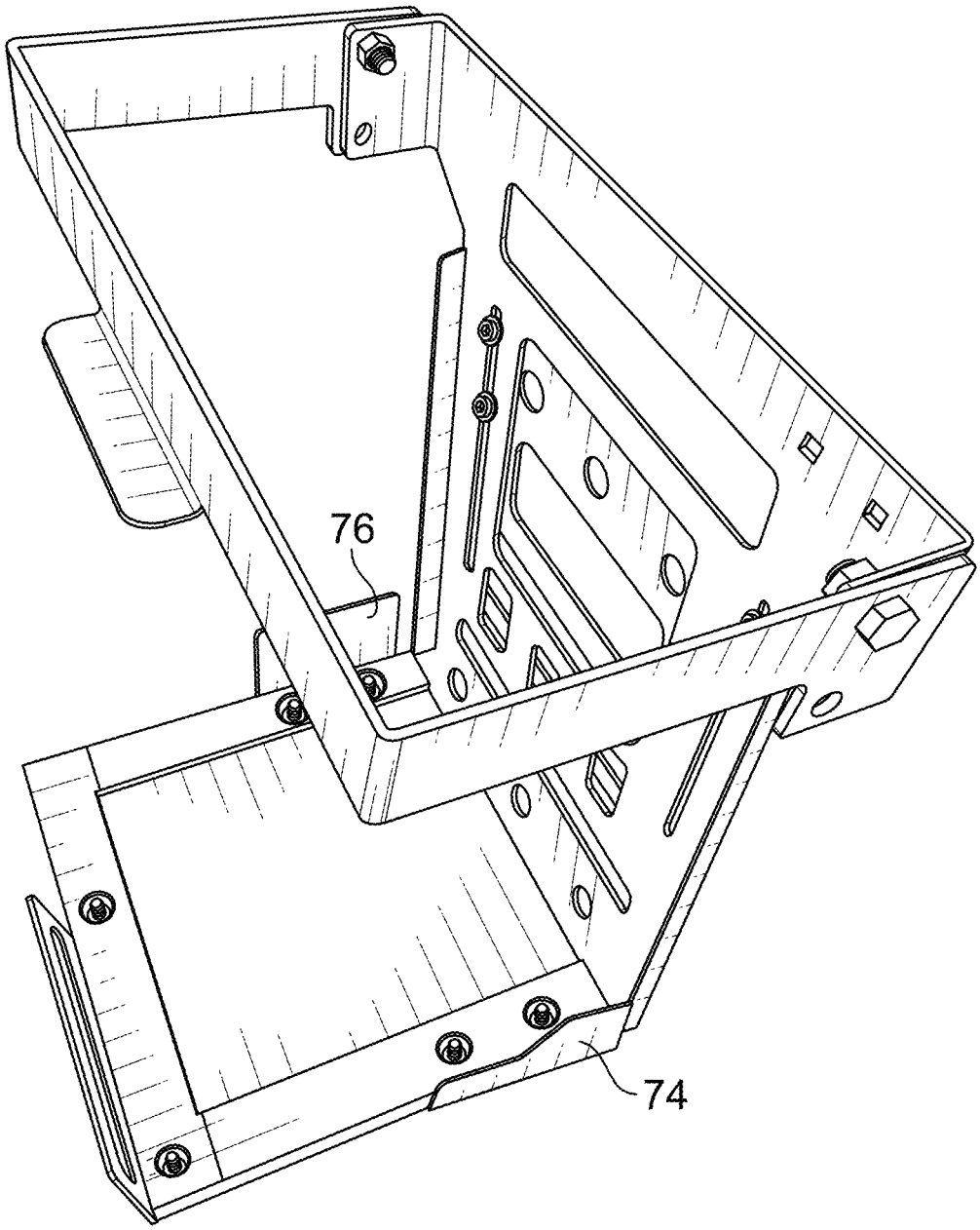
FIG. 2 is a top side perspective view of the adjustable backpack blower rack and Applicant's inventive design and, in particular, illustrating a first means, second means, and third means for adjusting the backpack blower rack.
Figure 3:
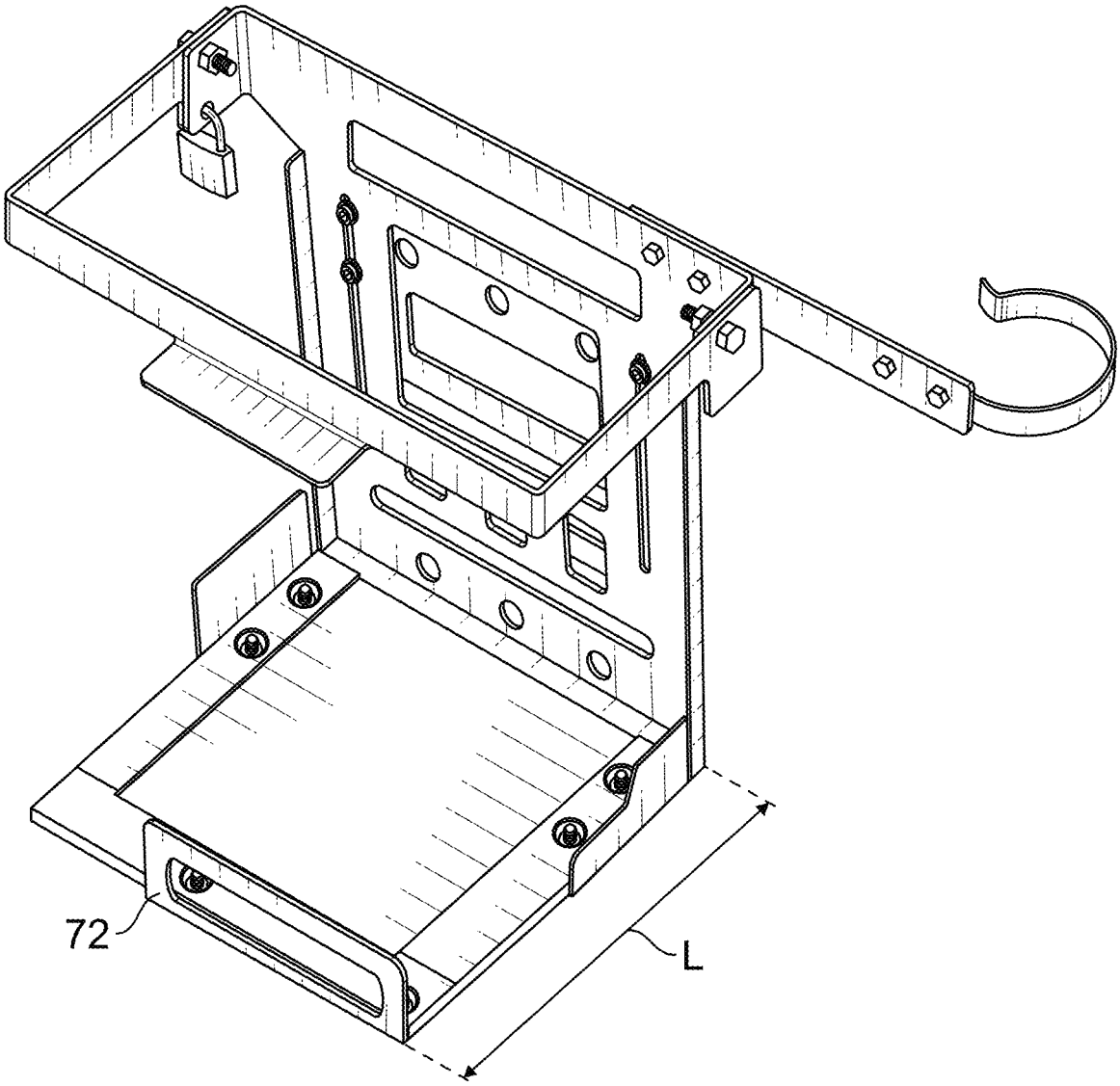
FIG. 3 is a top perspective view of the adjustable backpack blower rack and Applicant's inventive design and, in particular, illustrating a first means, second means, and third means for adjusting the backpack blower rack.
Figure 4:
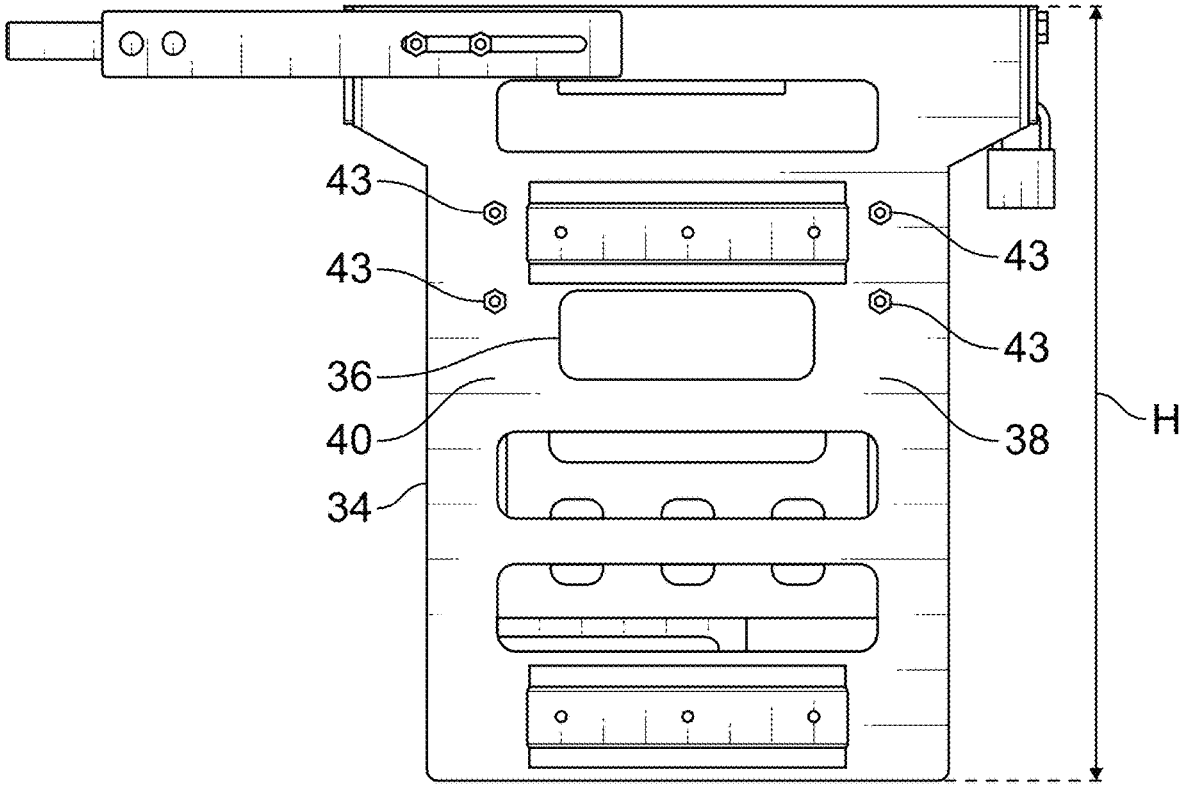
FIG. 4 is a back perspective view of the adjustable backpack blower rack and Applicant's inventive design and, in particular, illustrating a first means for adjusting the backpack blower rack.
Figure 5:
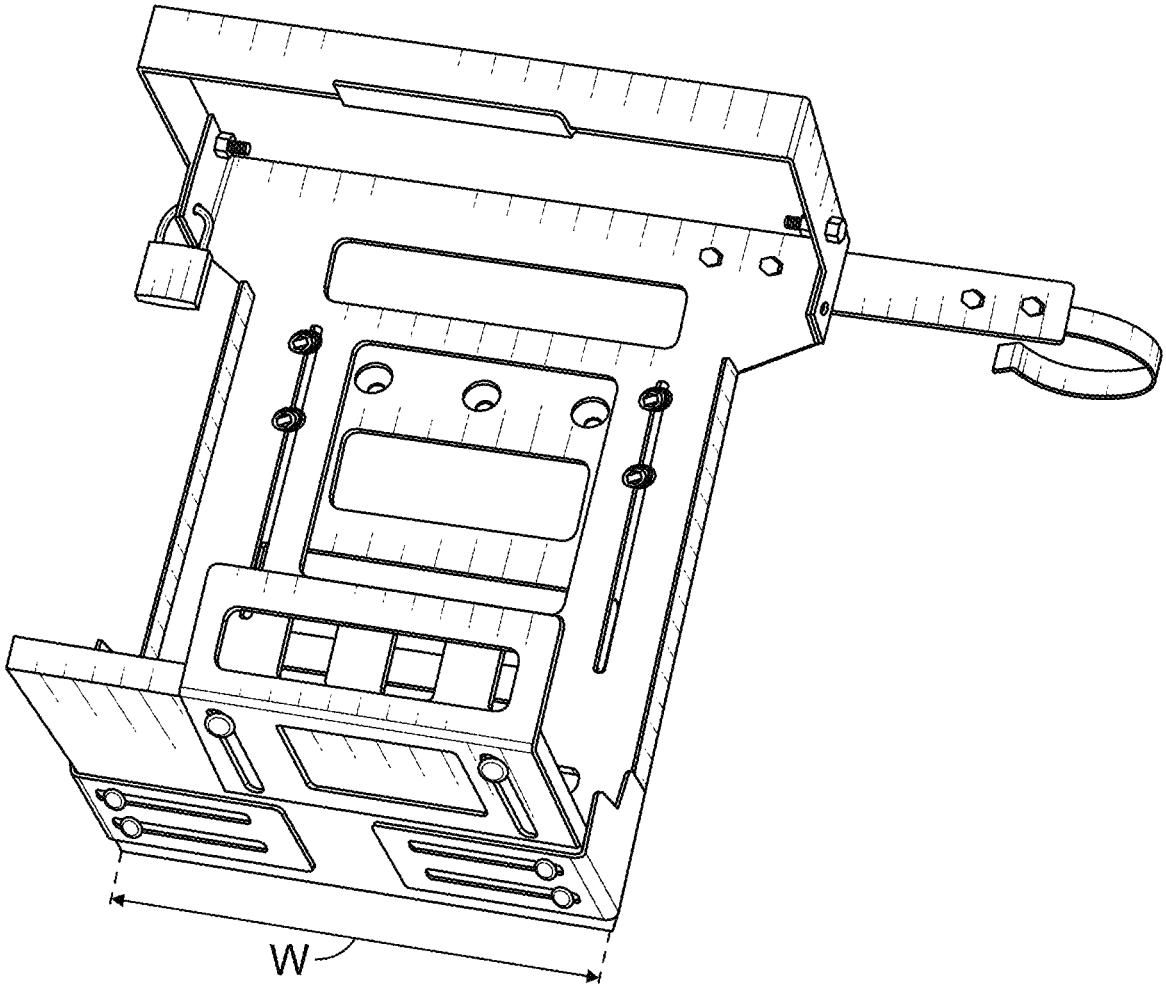
FIG. 5 is a bottom perspective view of the adjustable backpack blower rack and Applicant's inventive design and, in particular, illustrating a first means, second means, and third means for adjusting the backpack blower rack.
Figure 6:
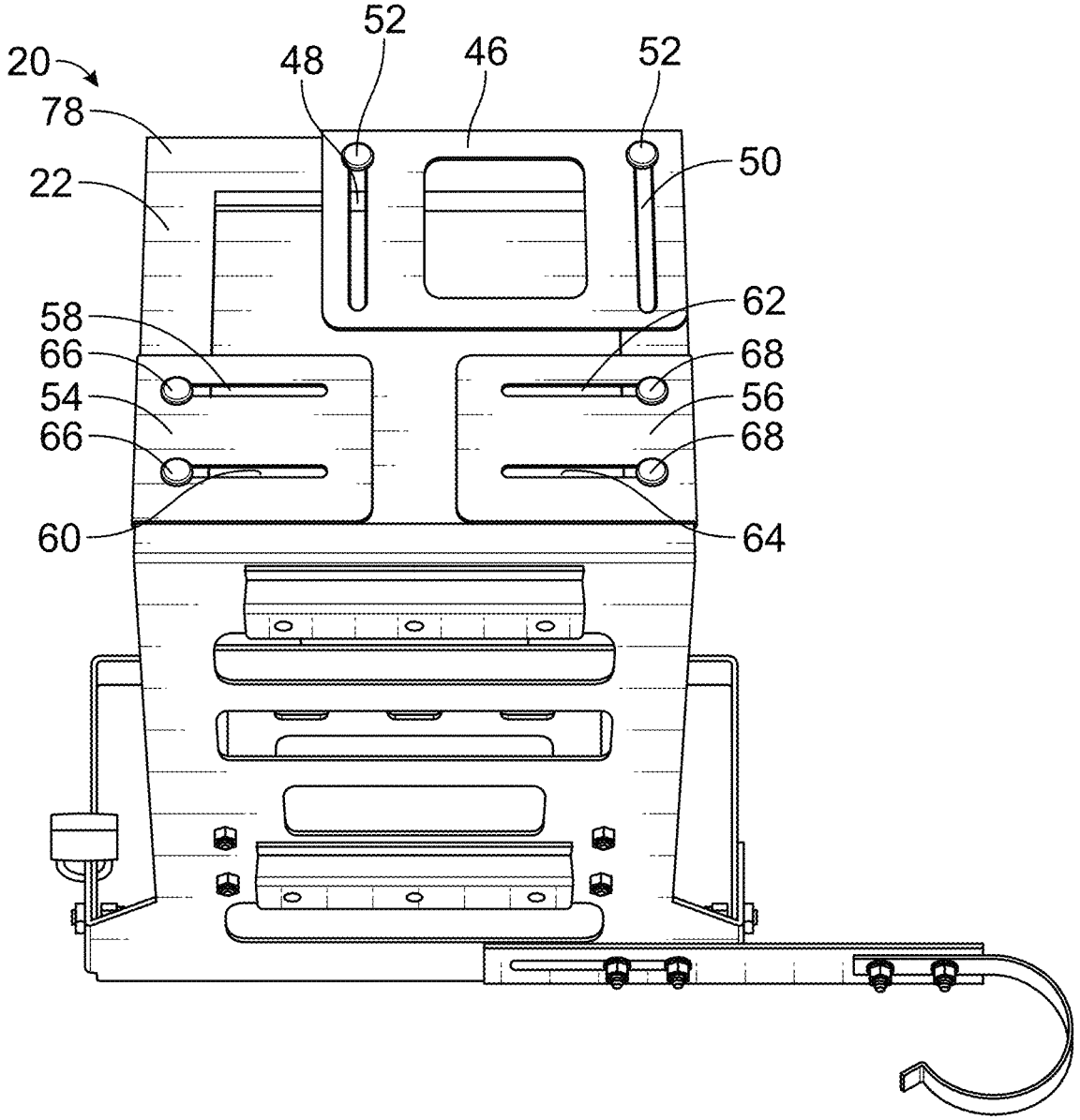
FIG. 6 is a back perspective view of the adjustable backpack blower rack and Applicant's inventive design and, in particular, illustrating a first means, second means, and third means for adjusting the backpack blower rack.
Figure 7:
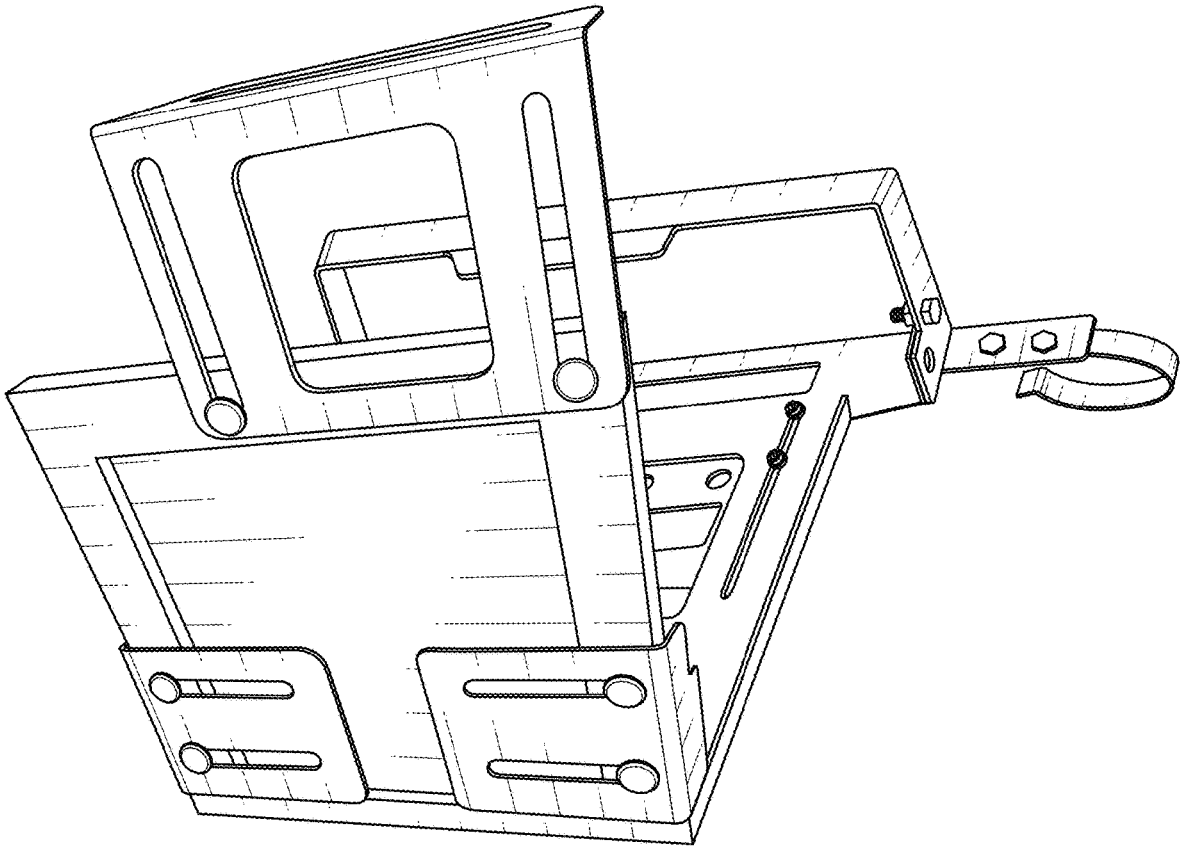
FIG. 7 is a back perspective view of the adjustable backpack blower rack and Applicant's inventive design and, in particular, illustrating a first means, second means (as shown in an expanded position), and third means for adjusting the backpack blower rack.
Figure 8:
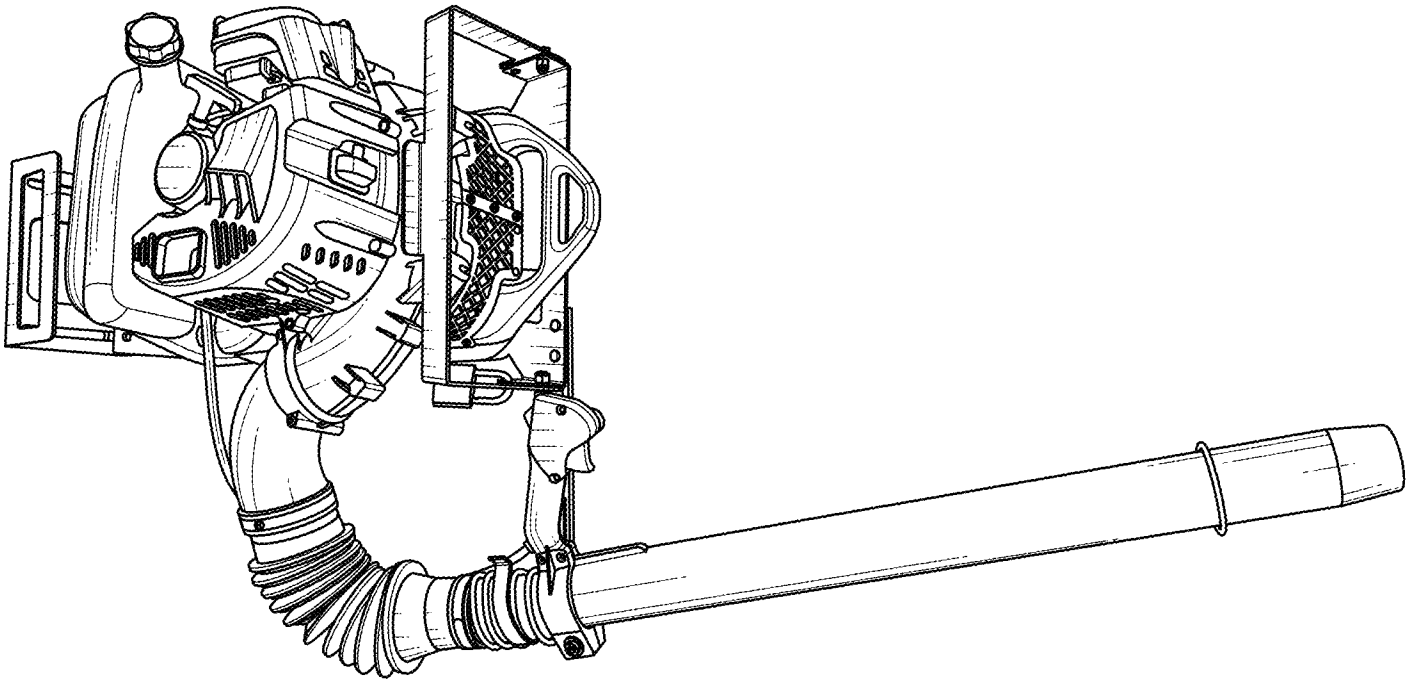
FIG. 8 is a front perspective view of the adjustable backpack blower rack and Applicant's inventive design and, in particular, illustrating the adjustable backpack blower rack as shown in use with, and retaining and/or holding, a blower in accordance with the present invention.
Figure 9:
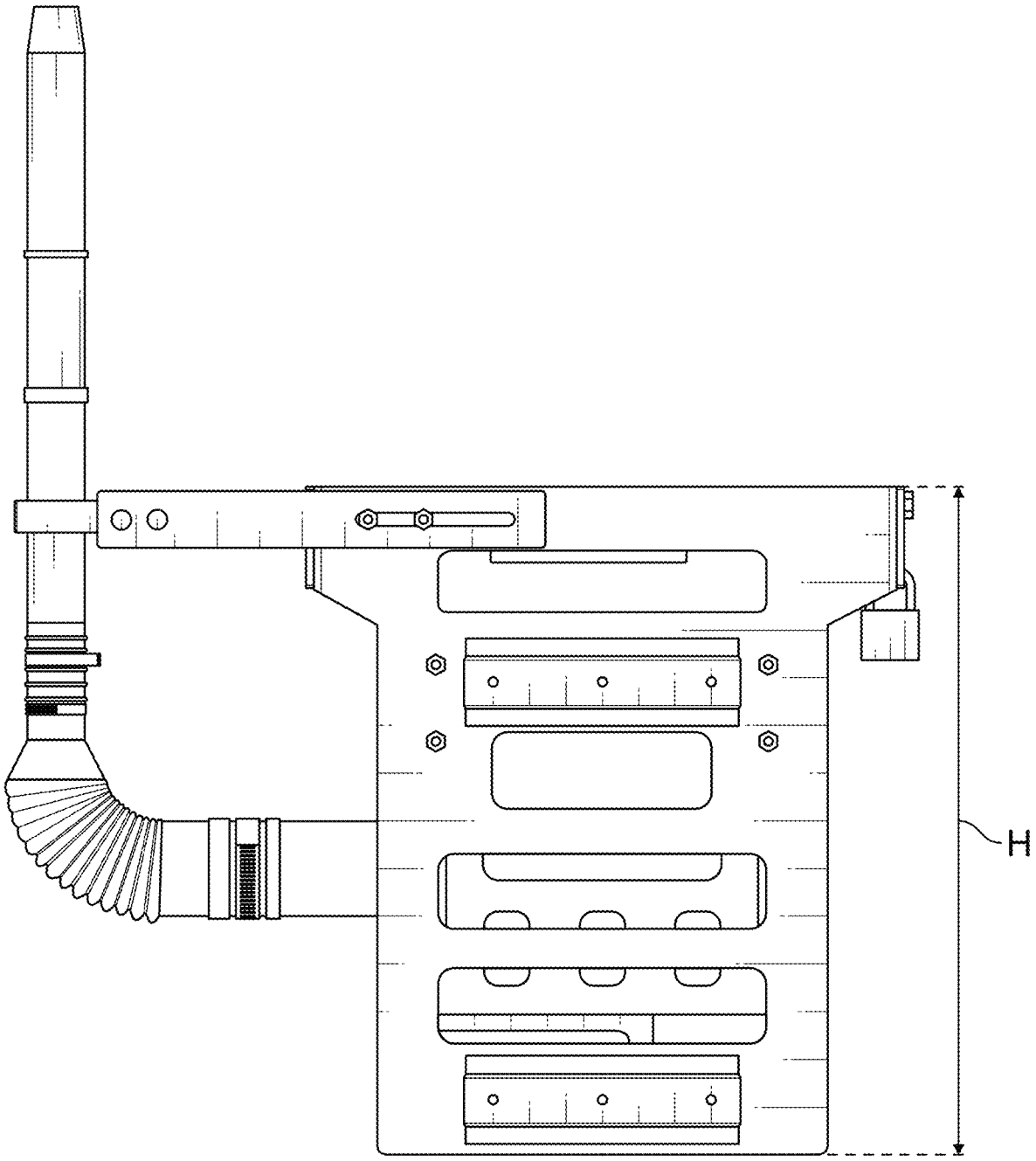
FIG. 9 is a back perspective view of the adjustable backpack blower rack and Applicant's inventive design and, in particular, illustrating the adjustable backpack blower rack as shown in use with, and retaining and/or holding, a blower arm in accordance with the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters. It will be further understood that FIGS. 1-8 are merely schematic representations of Applicant's adjustable backpack blower rack and some of the components may have been distorted from their actual scale for pictorial clarity.

In accordance with the present invention, and turning first to FIG. 1, there is illustrated a backpack blower rack 20 (also referred to herein as, "rack") 20 having a base 22, a back wall 24, preferably situated at a perpendicular angle to one another, and a top support frame 26.

For purposes of this patent application, the backpack blower rack 20 may be any type of and, operate in the same manner as any, backpack blower rack that is in use or operated by an operator that is known to one skilled in the art. To accomplish Applicant's invention, and as further described in more detail below, the backpack blower rack 20 is provided with a first means for adjusting the backpack blower rack 28 (also referred to herein as, "first means 28"), a second means for adjusting the backpack blower rack 32

(also referred to herein as, "second means 32"), and a third means for adjusting the backpack blower rack 30 (also referred to herein as, "third means 30") in which, each of these adjustments, either individually or in combination, allow the backpack blower rack 20 to be adjusted to fit all types and different sizes of blowers for use by an operator.

In the preferred embodiment, and as illustrated in FIGS. 1 through 7, the first means for adjusting the backpack blower rack 28 comprises a front surface 34 on the back wall 24, a back plate 36 having a plurality of holes 43 and situated and aligned adjacent to the back wall 24, a first slot track 38 and a second slot track 40 situated within the front surface 34, and a means for securing 42 the back plate 36 to the front surface 34. In an alternative embodiment, the first means 28 comprises only one track, either the first slot track 38 or the second slot track 40, but not both. Also, preferably, the means for securing 42 are bolts situated within the first slot track 38 and the second slot track 40 and nuts situated outside or on the exterior of the first slot track 38 and the second slot track 40 of the front surface 34 to work in combination with the bolts as the securing means. Alternatively, any other means known to one skilled in the art for the means for securing 42 may be used provided that it is used and/or accomplishes the invention as described herein.

When in use, and to adjust the height (or vertical adjustment) of the backpack blower rack 20, the means for securing 42 the back plate 36 to the front surface 34 is released (e.g., in a non-limiting example, the bolts and nuts are released) thereby releasing the back plate 36 from the front surface 34. When this occurs, the front surface 34 may be vertically raised or lowered in relation to the back plate 36 such that the means for securing 42 are traversed through each of the first slot track 38 and the second slot track 40 until the desired adjusted height (or vertical adjustment) of the backpack blower rack 20 is reached. Then, when this occurs, the means for securing 42 is tightened to frictionally re-secure the back plate 36 to the front surface 34 in this new, adjusted height (or vertical adjustment). Collectively, this is referred to herein as the means for traversing the front surface in relation to the back plate. In the preferred embodiment, and ease of reference, the height is identified as H in FIG. 4, and which may be expanded/adjusted as described herein up to a maximum height H of the backpack blower rack 20.

In the preferred embodiment, and as illustrated in FIGS. 1 through 7, the second means for adjusting the backpack blower rack 32 comprises a bottom surface 44 on the base 22 and providing a plurality of holes 80, a first base plate 46 (see FIG. 6) situated and aligned adjacent to an underside 78 of the base 22, a first base plate panel 72, a first slot track 48 and a second slot track 50 situated within the first base plate 46, and a means for securing 52 the first base plate 46 to the base 22. In an alternative embodiment, the second means 32 comprises only one track, either the first slot track 48 or the second slot track 50, but not both. Also, preferably, the means for securing 52 are bolts situated within the plurality of holes 80 and the first slot track 48 and the second slot track 50 and nuts situated outside or on the exterior of the first slot track 48 and the second slot track 50 of either the first base plate 46 or the base 22 to work in combination with the bolts as the securing means. Alternatively, any other means known to one skilled in the art for the means for securing 52 may be used provided that it is used and/or accomplishes the invention as described herein.

When in use, and to adjust the length (or front to back adjustment) of the backpack blower rack 20, the means for securing 52 the first base plate 46 to the base 22 is released (e.g., in a non-limiting example, the bolts and nuts are released) thereby releasing the first base plate 46 from the base 22. When this occurs, the first base plate 46 may be moved in a direction toward or away from the base 22 such that the means for securing 52 are traversed through each of the first slot track 48 and the second slot track 50 until the desired adjusted length (or front to back adjustment) of the backpack blower rack 20 is reached. Pulling on the first base plate panel 72 may also be used to assist in this movement. Then, when this occurs, the means for securing 52 is tightened to frictionally re-secure the first base plate 46 to the base 22 in this new, adjusted length (or front to back adjustment). Collectively, this is referred to herein as the means for traversing the first base plate in relation to the base. In the preferred embodiment, and ease of reference, the length (or front to back adjustment) is identified as L in FIG. 3, and which may be expanded/adjusted as described herein up to a maximum length L of the backpack blower rack 20, and as further illustrated in FIG. 7.

In the preferred embodiment, and as illustrated in FIGS. 1 through 7, the third means for adjusting the backpack blower rack 30 comprises the bottom surface 44 on the base 22 and providing a plurality of holes 82 and 84, a second base plate 54 (see FIG. 6) and a third base plate 56 (see FIG. 6) each situated and aligned adjacent to the underside 78 of the base 22, a second base plate panel 74, a first slot track 58 and a second slot track 60 situated within the second base plate 54 and a means for securing 66 the second base plate 54 to the base 22; and a third base plate panel 76, a first slot track 62 and a second slot track 64 situated within the third base plate 56 and a means for securing 68 the third base plate 56 to the base 22. In an alternative embodiment, the third means 30 comprises only one plate, either the second base plate 54 or the third base plate 56 and, if for the second base plate 54, only one track, either the first slot track 58 or the second slot track 60, but not both; and if for the third base plate 56, only one track, either the first slot track 62 or the second slot track 64, but not both. Also, preferably, the means for securing 66 are bolts situated within the plurality of holes 82 and the first slot track 58 and the second slot track 60 and nuts situated outside or on the exterior of the first slot track 58 and the second slot track 60 of either the second base plate 54 or the base 22 to work in combination with the bolts as the securing means; and likewise preferably, the means for securing 68 are bolts situated within the plurality of holes 84 and the first slot track 62 and the second slot track 64 and nuts situated outside or on the exterior of the first slot track 62 and the second slot track 64 of either the third base plate 56 or the base 22 to work in combination with the bolts as the securing means. Alternatively, any other means known to one skilled in the art for the means for securing 66 or means for securing 68 may be used provided that it is used and/or accomplishes the invention as described herein.

When in use, and to adjust the width (or side to side adjustment) of the backpack blower rack 20, the means for securing 66 the second base plate 54 to the base 22 is released (e.g., in a non-limiting example, the bolts and nuts are released) thereby releasing the second base plate 54 from the base 22. When this occurs, the second base plate 54 may be moved in a direction toward or away from the base 22 such that the means for securing 66 are traversed through each of the first slot track 58 and the second slot track 60 until the desired adjusted width (or side to side adjustment) of the backpack blower rack 20 is reached. Pulling on the second base plate panel 74 may also be used to assist in this movement. Then, when this occurs, the means for securing 66 is tightened to frictionally re-secure the second base plate 54 to the base 22 in this new, adjusted width (or side to side adjustment). Collectively, this is referred to herein as the means for traversing the second base plate in relation to the base. This adjustment is also referred to as "left side adjustment" or "first side adjustment").

Additionally, the means for securing 68 the third base plate 56 to the base 22 is released (e.g., in a non-limiting example, the bolts and nuts are released) thereby releasing the third base plate 56 from the base 22. When this occurs, the third base plate 56 may be moved in a direction toward or away from the base 22 such that the means for securing 68 are traversed through each of the first slot track 62 and the second slot track 64 until the desired adjusted width (or side to side adjustment) of the backpack blower rack 20 is reached. Pulling on the third base plate panel 76 may also be used to assist in this movement. Then, when this occurs, the means for securing 68 is tightened to frictionally re-secure the third base plate 56 to the base 22 in this new, adjusted width (or side to side adjustment). Collectively, this is referred to as the means for traversing the third base plate in relation to the base. This adjustment is also referred to as "right side adjustment" or "second side adjustment"). In the preferred embodiment, and ease of reference, the width (or side to side adjustment) is identified as W in FIG. 5, and which may be expanded/adjusted as described herein up to a maximum width W of the backpack blower rack 20.

In the preferred embodiment, the adjustment of the width W (or side to side adjustment) of the backpack blower rack 20 can be accomplished individually by either the left side adjustment (first side adjustment) or the right side adjustment (second side adjustment), or a combination of both.

In an alternate embodiment, the left side adjustment (first side adjustment) may be the same or different from the right side adjustment (second side adjustment) to achieve the desired adjustment of the width W.

Also, in the preferred embodiment, the top support frame 26 provides an opening 70 that is large enough to accommodate the maximum width W when the left side adjustment (first side adjustment) and the right side adjustment (second side adjustment) are achieved and the maximum length L is achieved and the maximum height H is achieved.

Thus, there has been provided a method and apparatus for a unique three-way adjustable backpack blower rack. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the disclosure contained herein and appended claims.

What is claimed is:

1. A device for accommodating varying sized blowers, comprising:

a base and a back wall fixedly secured to one another;

the base providing a bottom surface and an underside with a first set of holes, a second set of holes, and a third set of holes each extending through the base from the bottom surface to the underside of the base;

a first base plate situated on the underside of the base and providing a first base plate panel, a first slot track and a second slot track;

means for securing the first base plate to the base;

a second base plate situated on the underside of the base and providing a second base plate panel, a third slot track and a fourth slot track;

means for securing the second base plate to the base;

a third base plate situated on the underside of the base and providing a third base plate panel, a fifth slot track and a sixth slot track;

means for securing the third base plate to the base;

the back wall providing a front surface providing a seventh slot track and an eighth slot track and a back plate with a fourth set of holes and a fifth set of holes each extending through the back plate;

means for securing the front surface to the back plate.

2. The device of claim 1 where the base and the back wall are fixedly secured to one another at a perpendicular angle.

3. The device of claim 1 wherein the first set of holes in the base are in alignment with the first slot track and the second slot track of the first base plate.

4. The device of claim 1 wherein the second set of holes in the base are in alignment with the third slot track and the fourth slot track of the second base plate.

5. The device of claim 1 wherein the third set of holes in the base are in alignment with the fifth slot track and the sixth slot track of the third base plate.

6. The device of claim 1 wherein the fourth set of holes in the back plate are in alignment with the seventh slot track of the front surface.

7. The device of claim 1 wherein the fifth set of holes in the back plate are in alignment with the eighth slot track of the front surface.

8. The device of claim 1 wherein, using the means for traversing the first base plate in relation to the base, the width of a one side of the device may be increased at any first desired amount up to a maximum width for the one side of the device.

9. The device of claim 8 wherein, using the means for traversing the second base plate in relation to the base, the width of a other side of the device may be increased at any second desired amount up to a maximum width for the other side of the device.

10. The device of claim 9 wherein, using the means for traversing the third base plate in relation to the base, the length of the device may be increased at any third desired amount up to a maximum length of the device.

11. The device of claim 10 wherein, using the means for traversing the front surface in relation to the back plate, the height of the device may be increased at any fourth desired amount up to a maximum height of the device.

12. The device of claim 11 and further comprising a top support frame secured to the back wall.

13. The device of claim 12 wherein the top support frame provides an opening large enough to accommodate the maximum width for the one side of the device, maximum width for the other side of the device, the maximum length of the device, and the maximum height of the device.

* * * * *